United States Patent [19]

Fox

[11] 4,277,110

[45] Jul. 7, 1981

[54] EARTH BORING BIT WITH ECCENTRIC SEAL GROOVE

[75] Inventor: Lenwood Fox, Grand Prarie, Tex.

[73] Assignee: Dresser Industries, Inc., Dallas, Tex.

[21] Appl. No.: 78,357

[22] Filed: Sep. 24, 1979

[51] Int. Cl.[3] ..... F16C 33/72

[52] U.S. Cl. ..... 308/8.2; 308/36.1

[58] Field of Search ..... 308/8.2, 36.1, 187, 308/187.1; 175/371, 372

[56] References Cited

U.S. PATENT DOCUMENTS

| | | | |
|---|---|---|---|
| 3,384,426 | 5/1968 | Schumacher | 308/8.2 |
| 3,397,928 | 8/1968 | Galle | 308/36.1 |

*Primary Examiner*—Lenard A. Footland

*Attorney, Agent, or Firm*—Eddie E. Scott; Fred A. Winans

[57] ABSTRACT

A rolling cone cutter earth boring bit is provided with a sealing system that results in the seal being squeezed uniformly around the seal circumference during drilling. A seal groove is machined in the bearing pin. The seal groove is machined about an axis that is offset from the central axis of the bearing pin in the direction of the unloaded side of the bearing pin. When the bit is drilling and the bearing pin is loaded the seal will run on a diameter concentric with the diameter of the rolling cutter and will see uniform squeeze around its circumference.

2 Claims, 4 Drawing Figures

EARTH BORING BIT WITH ECCENTRIC SEAL GROOVE

BACKGROUND OF THE INVENTION

The present invention relates in general to the art of earth boring and more particularly to a rotary rock bit with an improved sealing system. The present invention is especially adapted for use on that type of rotary rock bit popularly known as a three cone bit; however, its use is not restricted thereto and the bearing system of the present invention can be used in other earth boring bits wherein an improved bearing system is required.

A three cone rotary rock bit is adapted to be connected as the lower member of a rotary drill string. As the drill string is rotated the bit disintegrates the formations to form an earth borehole. The three cone rotary rock bit includes three individual arms that extend angularly downward from the main body of the bit. The lower end of each arm is shaped to form a bearing pin or journal. A cone cutter is mounted upon each bearing pin and adapted to rotate thereon. The cone cutters include cutting structure on their outer surfaces that serves to disintegrate the formations as the bit is rotated.

A rotary rock bit must operate under very severe environmental conditions and the size and geometry of the bit is restricted by the operating characteristics. At the same time, the economics of petroleum production demand a longer lifetime and improved performance from the bit. In attempting to provide an improved bit, new and improved materials have been developed for the cutting structure of the cone cutters thereby providing a longer useful lifetime for the cone cutters. This has resulted in the bearing and sealing systems being generally the first to fail during the drilling operation. Consequently, a need exists for improved bearing and sealing systems to extend the useful lifetime of the bit. One of the problems encountered with radial seals in rock bits is that when the bearing is loaded the seal sees unequal squeeze on top and bottom. This will tend to knead the seal as well as cause leaks at the top where the squeeze is a minimum. The present invention minimizes this condition and promotes greater seal life and improves bit performance by causing the seal to run concentrically.

DESCRIPTION OF PRIOR ART

In U.S. Pat. No. 3,397,928 to E. M. Galle, patented Aug. 20, 1968, a seal means for drill bit bearings is shown. The seal means includes a shaft rigidly secured to a drill bit body with a bearing surface formed thereon. A cutter element is rotatably mounted to said shaft and includes a bearing surface thereon that opposes and engages the bearing surface on the shaft. A resilient packing ring is positioned in a groove in one of the surfaces. The packing ring, the groove and an opposing surface are sized such that upon assembly of the cutter element upon the shaft the cross sectional thickness of the packing ring is compressed by not less than substantially 10% of this thickness prior to assembly of the cutter element upon the shaft.

Other drill bit bearing sealing systems are shown in U.S. Pat. No. 1,884,965 to Baggett, U.S. Pat. No. 2,797,067 to Fisher, U.S. Pat. No. 3,075,781 to Atkinson, U.S. Pat. No. 3,096,835 to Neilson, U.S. Pat. No. 3,151,691 to Goodwin, U.S. Pat. No. 3,303,898 to Bercaru, U.S. Pat. No. 3,529,840 to Durham and U.S. Pat. No. 3,862,762 to Millsapps.

SUMMARY OF THE INVENTION

The present invention provides a rolling cutter earth boring bit with an improved sealing system. At least one cantilevered bearing pin extends from the arm of the bit. A rolling cone cutter is rotatably mounted on the bearing pin. A seal groove on the bearing pin is machined eccentrically to the bearing pin. The seal will run on concentric diameters with the rolling cutter and will see uniform squeeze around its circumference when the bearing is loaded. The above and other objects and advantages of the present invention will become more apparent from a consideration of the following detailed description of the invention when taken in conjunction with the drawings.

DETAILED DESCRIPTION OF THE INVENTION

Figure 1:
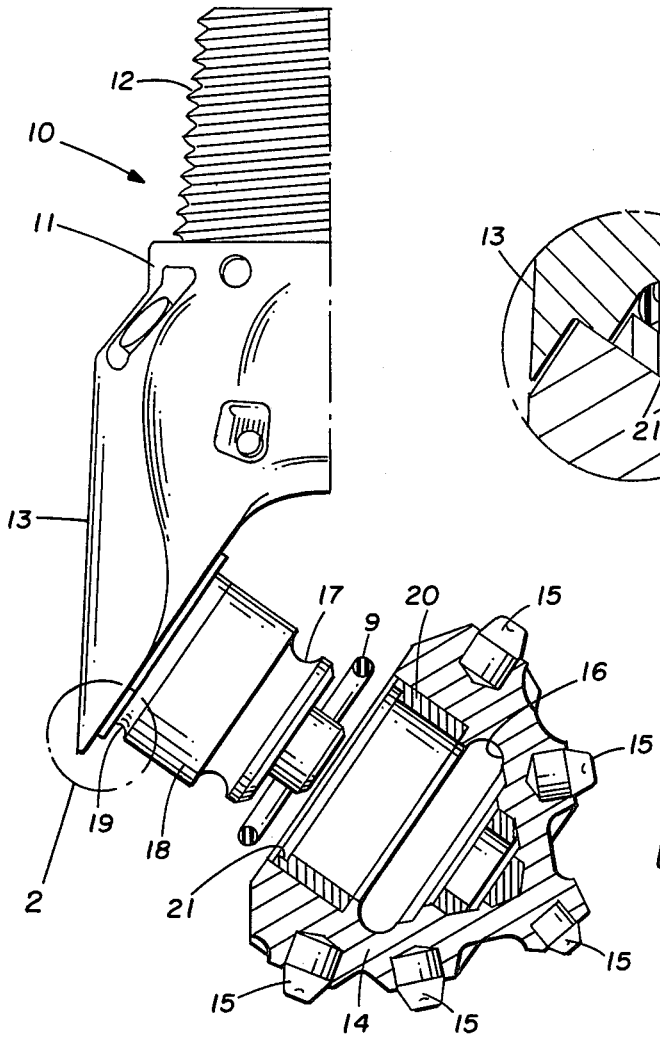
FIG. 1 illustrates one arm of a rotary rock bit constructed in accordance with the present invention.

Referring now to the drawings and to FIG. 1 in particular, illustrated therein and generally designated by the reference number 10 is a three cone sealed bearing rotary rock bit. The bit 10 includes a bit body 11, including an upper threaded portion 12. The threaded portion 12 allows the bit 10 to be connected to the lower end of a rotary drill string (not shown). Depending from the bit body 11 are three substantially identical arms with only the arm 13 being shown in FIG. 1. The lower end of each of the arms is provided with an extended bearing pin comprising a journal portion and the details of this journal portion will be discussed subsequently. Three rotary cone cutters are rotatably positioned on the respective three bearing pins extending from the arms. The cutter 14 is shown in FIG. 1. Each of the cutters includes cutting structure on its outer surface adapted to disintegrate the earth formations as the bit 10 is rotated and moved downward. The cutting structure is shown in the form of tungsten carbide inserts 15. However, it is to be understood that other cutting structures such as steel teeth may be used as a cutting structure on the cone cutters.

The bit 10 includes a central passageway extending along the central axis of body 11 to allow drilling fluid to enter from the upper section of the drill string (not shown) immediately above and pass downward through jet nozzles past the cone cutters. In use, the bit 10 is connected as the lower member of a rotary drill string (not shown) and lowered into the well bore until the cone cutters engage the bottom of the well bore. Upon engagement with the bottom of the well bore, the drill string is rotated, rotating bit 10 therewith. Drilling fluid is forced down through the interior passage of the rotary drill string by mud pumps located at the surface. The drilling fluid continues through the central passageway of bit 10, passing through the nozzles past the cutting structure of the cutters to the bottom of the well bore, thence upward in the annulus between the rotary drill string and the wall of the well bore, carrying with it the cuttings and debris from the drilling operation.

The bearing system of the bit, including the seal, must insure free rotation of the cone cutters under the severe drilling environmental conditions. The improved sealing system of the present invention provides an earth boring bit with a long lifetime and that will withstand the conditions encountered in drilling a deep well. The elongated lower portion of arm 13 forms the bearing pin 18 comprising a journal portion and the rotatable cutter 14 is mounted upon the journal portion. A seal ring is positioned between the cutter and bearing pin. The prior art bearings would cause the journal and cutter to run eccentrically, resulting in excessive squeezing of the seal in the loaded area and reduced squeeze in the unloaded area of the journal. The present invention causes the seal centerline and cutter centerline to coincide when the bit is loaded and produce more evenly distributed squeeze on the seal. The loaded portion of the bearing pin includes an eccentrically machined seal groove.

A series of ball bearings (not shown) that bridge between raceways 16 and 17 insure that rotatable cutter 14 is rotatably locked on bearing pin 18. The rotatable cutter 14 is positioned upon bearing pin 18 and the series of ball bearings inserted through a bore extending into arm 13. After the ball bearings are in place, a plug is inserted in the bore and welded therein. A flexible seal 9 forms a seal between a bushing 20 in cutter 14 and groove 19 in bearing pin 18 to prevent loss of lubricant or contamination of the lubricant from materials in the well bore. The seal 9 is positioned in the eccentric groove 19 in the bearing pin.

Figure 2:
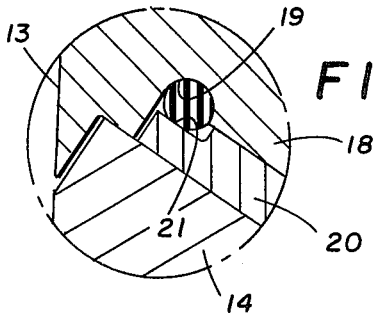
FIG. 2 is an enlarged view of the lower portion of the seal groove of the bit shown in FIG. 1.

Referring now to FIG. 2, an enlarged view of the groove 19 in bearing pin 18 is shown. One of the prior art rock bit sealing problems involves the clearance between the bearing pin and cutter. When the bit is loaded on the bottom of the borehole with the underside of the bearing pin in contact with the cutter, all the clearance is on the unloaded side of the bearing; thus, increasing O-ring squeeze in the loaded area and reducing O-ring squeeze in the unloaded area. The present invention permits the cone cutter to run offset from the bearing pin axis but concentric and with the seal groove in the bearing pin to equalize squeeze on the O-ring seal at both the upper, unloaded and the loaded areas of the bearing.

The bearing system of the present invention insures free rotation of the cone cutters under the severe drilling environmental conditions. The improved sealing system of the present invention provides an earth boring bit with a long lifetime and that will withstand the conditions encountered in drilling a deep well. The elongated lower portion of arm 13 forms the bearing pin 18 and the rotatable cutter 14 is mounted upon the bearing pin. The prior art bearing and sealing systems allow the cutter and seal to run eccentrically on the bearing pin, resulting in excessive squeezing of the rubber O-ring in the loaded area and reduced and possibly insufficient squeeze in the unloaded area of the bearing pin. The present invention causes the cone cutter centerline and seal centerline to coincide when the bit is loaded and produce more evenly distributed squeeze on the O-ring seal. This will be illustrated with reference to FIGS. 3 and 4.

Figure 3:
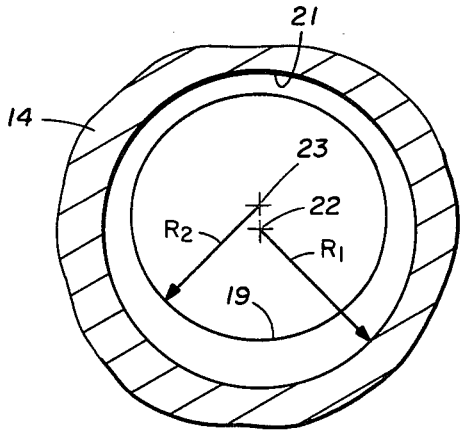
FIG. 3 is a sectional view of the bearing pin and a superimposed view of the rolling cone cutter of the bit shown in FIG. 1 with the bearing in an unloaded condition.

Referring now to FIG. 3, a sectional view of cutter 14 and bearing pin 18 is shown with the bit in an unloaded condition. The seal groove 19 is provided by offset grinding or machining. The central axis 23 of the seal groove 19 is offset from the central axis 22 of the bearing pin. The offset of axis 23 with respect to axis 22 is in the direction of the unloaded area on the upper portion of bearing pin 18. When the bit is in the unloaded condition as shown in FIG. 3 the central axis 22 of the bearing pin 18 and the central axis of rolling cutter 14 coincide. The radius of the bearing pin 18 and the inner radius $R_1$ of the bushing 20 in rolling cutter 14 extend about axis 22. The radius $R_2$ of the seal groove 19 extends about axis 23.

Figure 4:
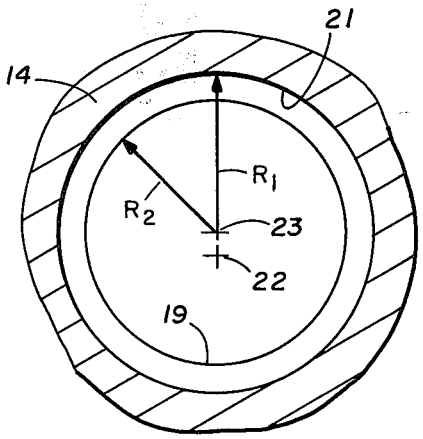
FIG. 4 is the view of FIG. 2 with the bearing in a loaded condition.

Referring now to FIG. 4, a sectional view of cutter 14 and bearing pin 18 is shown with the bit in a loaded condition. The loading of the bit has resulted in the bearing pin 18 being moved downward with respect to the rolling cutter 14 by the amount of necessary assembly clearance therebetween. The central axis 23 of the seal groove 19 and the central axis of the rolling cutter now coincide. The radius $R_2$ of the seal groove 19 still extends about axis 23, however, the radius $R_1$ of the inner surface 21 of the bushing 20 in rolling cutter 14 now also extends about axis 23. Since the radius $R_2$ and radius $R_1$ extend about coincident axes, the squeeze on the seal will be uniform.

The present invention improves the sealing effect of O-ring seal 9. The prior art bearings allowed the seal to run eccentrically, resulting in excessive squeezing of the rubber O-ring in the loaded area and reduced, possibly insufficient, squeeze in the unloaded area of the bearing pin. The present invention allows the seal axis and cutter axis to coincide and produce more evenly distributed squeeze on the O-ring seal when the bit is loaded. The lifetime and performance of the O-ring seal will be extended because of the improved even loading.

The embodiments of an invention in which an exclusive property or privilege is claimed are defined as follows:

1. A rolling cutter earth boring bit, comprising:

a bit body;

at least one bearing pin extending from said bit body, said bearing pin having a central axis;

a rolling cone cutter rotatably mounted on said bearing pin with at least some radial clearance therebetween;

a seal groove on said bearing pin having a center offset from said central axis in the direction of the unloaded surface; and a seal positioned in said seal groove that is substantially evenly squeezed during operation of said bit.

2. An improved rolling cutter earth drilling bit, comprising a bit body, having at least one downwardly extending arm, a cantilevered bearing pin extending from said arm, a seal groove on said bearing pin, a rolling cutter rotatably mounted on said bearing pin with at least some radial clearance therebetween, a seal positioned around said bearing pin in said seal groove, said improvement comprising:

said seal groove having a center offset from the central axis of said bearing pin in the direction of the unloaded surface of said pin when said bit is drilling whereby said seal is substantially evenly squeezed between said cone and said groove during said drilling operation.

* * * * *